US012157981B2

(12) United States Patent
Chen et al.

(10) Patent No.: US 12,157,981 B2
(45) Date of Patent: Dec. 3, 2024

(54) METHOD FOR PREVENTION AND CONTROL OF SUPER LARGE-SCALE FLOODS AND DEBRIS FLOWS

(71) Applicants: INSTITUTE OF MOUNTAIN HAZARDS AND ENVIRONMENT CHINESE ACADEMY OF SCIENCES, Sichuan (CN); TSINGHUA UNIVERSITY, Beijing (CN)

(72) Inventors: Jiangang Chen, Sichuan (CN); Xiaoqing Chen, Sichuan (CN); Yifei Cui, Beijing (CN); Yong You, Sichuan (CN); Huayong Chen, Sichuan (CN); Wanyu Zhao, Sichuan (CN); Shuai Li, Sichuan (CN)

(73) Assignees: INSTITUTE OF MOUNTAIN HAZARDS AND ENVIRONMENT CHINESE ACADEMY OF SCIENCES, Sichuan (CN); TSINGHUA UNIVERSITY, Beijing (CN)

( * ) Notice: Subject to any disclaimer, the term of this patent is extended or adjusted under 35 U.S.C. 154(b) by 246 days.

(21) Appl. No.: 17/783,745

(22) PCT Filed: Aug. 28, 2020

(86) PCT No.: PCT/CN2020/111994
§ 371 (c)(1),
(2) Date: Jun. 9, 2022

(87) PCT Pub. No.: WO2021/253635
PCT Pub. Date: Dec. 23, 2021

(65) Prior Publication Data
US 2023/0002992 A1 Jan. 5, 2023

(30) Foreign Application Priority Data
Jun. 20, 2020 (CN) ..... 202010569799.1

(51) Int. Cl.
*E02B 7/04* (2006.01)
*E02B 3/10* (2006.01)
(Continued)

(52) U.S. Cl.
CPC ..... *E02B 7/04* (2013.01); *E02B 3/10* (2013.01); *E02D 27/16* (2013.01); *E02D 27/40* (2013.01);
(Continued)

(58) Field of Classification Search
CPC ... E02D 27/40; E02B 3/10; E02B 7/02; E02B 7/04; E02B 7/08
See application file for complete search history.

(56) References Cited

U.S. PATENT DOCUMENTS

2014/0154012 A1* 6/2014 Chen ..... E02B 7/02 405/116

FOREIGN PATENT DOCUMENTS

CN 101701454 A * 5/2010
CN 105525595 A * 4/2016
(Continued)

*Primary Examiner* — Frederick L Lagman
(74) *Attorney, Agent, or Firm* — Scully, Scott, Murphy & Presser, P.C.

(57) ABSTRACT

The invention provides a method for preventing super large-scale floods and debris flows. First, the scale corresponding to certain standard floods in the watershed is evaluated based on field investigations and historical data. Second, the design standards of the system are chosen based on the prevention of super large-scale floods, and the design standard of critical control engineering is further determined. Finally, the design methods of check dams with different functional zones are proposed according to the
(Continued)

design standards of critical control engineering. The invention allows part of the key control dam to fail under safe operating conditions of the entire system by increasing the cross-sectional areas and the flow discharges. The unbroken foundation of the dam can effectively control the channel entrainment and regulate the cross-sectional discharge. The design is helpful in mitigating giant floods and debris flows, thus protecting downstream infrastructures.

9 Claims, 1 Drawing Sheet

(51) Int. Cl.
*E02D 27/16* (2006.01)
*E02D 27/40* (2006.01)

(52) U.S. Cl.
CPC ..... *E02D 2300/002* (2013.01); *E02D 2300/0034* (2013.01)

(56) References Cited

FOREIGN PATENT DOCUMENTS

| | | | | | |
|---|---|---|---|---|---|
| CN | 107034853 | A | * | 8/2017 | |
| CN | 107090804 | A | * | 8/2017 | ..... E02B 5/08 |
| CN | 109610404 | A | * | 4/2019 | ..... C02F 3/32 |
| CN | 110443741 | A | * | 11/2019 | ..... G06Q 10/0635 |
| JP | 2009197433 | A | * | 9/2009 | |
| KR | 100901886 | B1 | * | 6/2009 | |
| KR | 20150143497 | A | * | 12/2015 | |
| KR | 20160077357 | A | * | 7/2016 | |

* cited by examiner

METHOD FOR PREVENTION AND CONTROL OF SUPER LARGE-SCALE FLOODS AND DEBRIS FLOWS

TECHNICAL FIELD

The present invention belongs to the fields of disaster prevention and mitigation, geotechnical and structural engineering design, and railway and highway engineering and specifically relates to a method for preventing and controlling super large-scale floods and debris flows.

BACKGROUND OF THE INVENTION

Floods and debris flows are catastrophic geological disasters in mountainous communities. Specifically, super large-scale glacial debris flows and glacial lake outburst floods pose severe threats to highways, railways, and oil pipelines in high-altitude areas. Under the background of climate change and the associated cryospheric response, catastrophic mass flows have experienced more favorable conditions for initiation and an increase in frequency. Therefore, standards for the construction of major projects and safe operations in high-altitude areas are increasing accordingly. Thus, the prevention and mitigation of mega-floods and catastrophic debris flows are becoming increasingly urgent.

In high-altitude areas such as the Qinghai-Tibet Plateau, large-scale glacial lake outburst floods and debris flows caused by rapid melting of glaciers (with a total discharge volume of more than $100\times10^4$ $m^3$ or a peak flow of more than 2000 $m^3/s$) are common occurrences. Conventional prevention engineering works, such as check dams and drainage channels, are not effective in these conditions. For example, the 2010 Zhouqu debris flow in China, with a total volume of $180\times10^4$ $m^3$ and a peak flow of 1830 $m^3/s$, destroyed all the check dams in the gully and blocked the river. However, on Sep. 23, 1953, a massive glacial debris flow occurred in Guxiang gully, Tibet; the peak discharge was $2.86\times10^4$ $m^3/s$, and the total amount of solid material discharged at one time reached $1100\times10^4$ $m^3$. The magnitude of this debris flow was much larger than that of the Zhouqu debris flow. The Guxiang debris flow destroyed all prevention projects and blocked the river downstream. As such, floods and debris flows associated with glaciers are more difficult to prevent with general methods.

Therefore, under the background of climate warming, the occurrence probability of super large-scale floods and debris flows is increasing, and they are sudden, have a high flood peak discharge, and have strong destructiveness. Finding a method to prevent super large-scale floods and debris flows and a design method for key engineering in gullies is very urgent. It can not only effectively regulate the cascading outburst process of glacial-related floods and debris flows and dampen the strong scouring and blocking effect but also effectively protect downstream highways, railways and other major projects, which has significant practical significance and engineering application value.

SUMMARY OF THE INVENTION

This invention provides a method for preventing super large-scale glacial-related floods and debris flows and solves at least one of the aforementioned technical problems.

To achieve this purpose, a method for preventing super large-scale floods and debris flows is developed, which includes the following steps:

Step 1: We determine the planning and design standards of the preventative engineering system in the basin, as well as the design protection level and standards of the key project according to the protection standards of downstream objects. According to an investigation and measurements of historical disasters in the basin, we obtain the basin topography. Based on a field investigation of historical floods and debris flow traces or a hydrological calculation of a small watershed, the peak discharge or the total debris flow volume can be evaluated. The source materials of debris flows can also be estimated through a field investigation of the distribution of materials in the basin.

Step 2: When considering the potential super large-scale debris flows in the watershed, we can arrange artificial structures or artificial structure arrays to control the initial amount of source materials. These artificial structures not only protect the entrainment by flows but also increase the flow friction, which contributes to regulating energy dissipation.

Step 3: If a super large-scale flood/debris flow erupts in the basin under a certain design standard, a combination of engineering works, namely, a drainage channel, check dam, and retaining basin, should be used to regulate the flows.

Step 4: If a super large-scale flood/debris flow erupts in the basin under a certain design standard, field investigations and sampling tests are further used to determine the design and layout, as well as the location and quantity of key projects in the basin.

Key control dams should be installed after every 3-5 common check dams, and the storage capacity of the key control dam should be equal to or greater than the total storage capacity of its upstream common check dams. This ensures that the key control dam can retain the sediments that come from the upstream check dams when they break out.

Step 5: The key control dam can be divided into four regions, namely, region A, the foundation of the dam body; region B, the left shoulder of the dam; region C, the right shoulder of the dam; and region D, the discharge outlet and overtopping weir. The four regions are designed based on different protection standards, i.e., regions A, B, and C are designed with the same standard, and pile foundations can be used to reinforce the foundation. The design standard of region D is lower than that of the other three regions. Region D is allowed to break when encountering super large-scale floods and debris flows, while the other regions A, B, and C are not allowed to burst.

Preferably, artificial structures or artificial structure arrays can be arranged in the source area if there is a high possibility of super large-scale debris flows in the basin. These structures can be prefabricated and distributed evenly or unevenly in the source area.

Ideally, the geometric parameters (e.g., length, width, and height) of the critical control project are determined based on terrain investigation. The thickness of the project foundation and the accumulation layer on both banks can be obtained through site drilling tests and indoor laboratory experiments.

If possible, according to the design and protection standards of railways, highways, and other important facilities in the basin, the design and protection standards of the non-outburst damaged area of the key control project are required to be higher than those of the outburst area.

The same design standards adopted in regions A, B, and C are greater than or equal to the protection standards of railways, highways, and other important facilities. These regions are constructed with high-grade reinforced concrete.

Preferably, the design standards adopted in region D are lower than those in regions A, B, and C. The building materials of region D are constructed with reinforced concrete, steel cable nets, and flexible protective nets. In the case of super large-scale glacial-related floods and debris flows, region D is allowed to burst.

The depth of the pile foundation should be determined as follows: the effective length of the pile foundation ($H_{pile}$) is greater than or equal to the dam height ($H_{dam}$) and crosses through the depth of loose deposits ($H_{deposits}$), $H_{pile}$>Max ($H_{dam}$, $H_{deposits}$).

The potential failure areas of region D of the critical control dam should include the discharge hole. When the impact force/pressure on the dam exceeds the design standard ($P>P_{design}$) or the debris flow discharges (calculated according to the real-time monitoring data of floods and debris flows, Q=BHV) exceed the design discharges, region D may begin to fail.

Whether the anchorage forms of regions B and C are designed as anti-slide piles or prestressed anchorages is based on the thickness of the loose deposit layer ($h_{deposit\ layer}$) on the shoulders of the dam and the impact resistance requirements of the dam shoulders under the design standards. Moreover, the anchorage depth ($h_{anchorage}$) is determined, which is larger than the depth ($h_{anchorage}>h_{deposit\ layer}$).

Compared with existing technologies, the beneficial effects of the presently proposed method for the prevention and control of super large-scale floods and debris flows are as follows: this method allows part of the key control dam to break under the condition of ensuring the safe operation of the entire system, thereby increasing the cross-sectional areas and the flow discharges. The unbroken foundation of the dam can effectively control the channel undercutting and regulate the cross-sectional velocity. These controls are helpful to minimize the threat and harm to downstream areas. At the same time, the key control dam can be quickly restored to its original form after the burst, thereby saving construction time and greatly reducing the maintenance cost of the project.

Figure 1:
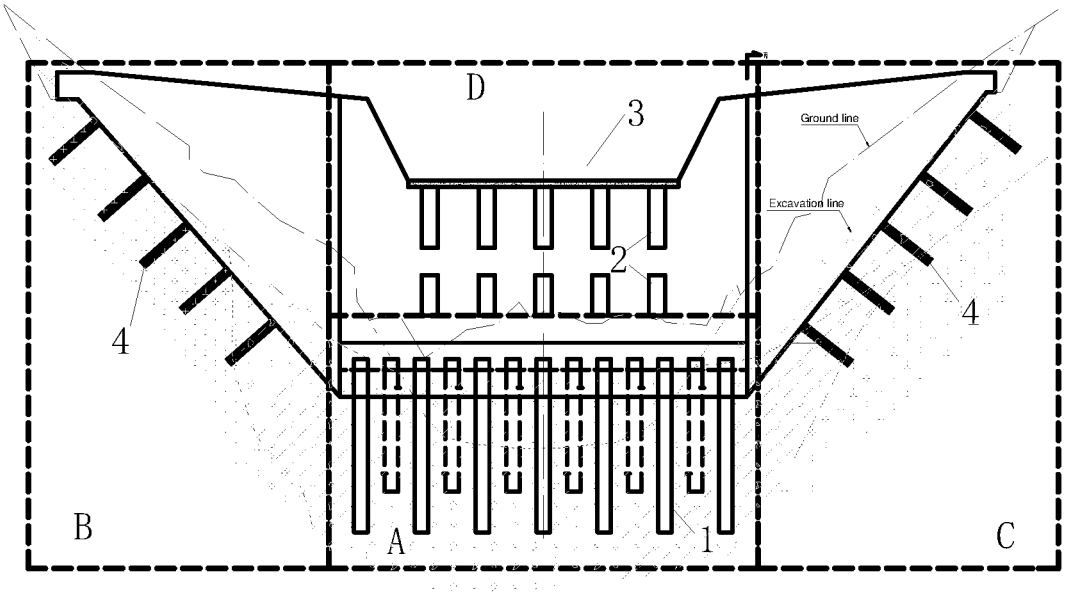
FIG. 1 is a critical control dam constructed of reinforced concrete.

| Reference signs in the figures are as follows: | |
|---|---|
| A: Region A | B: Region B |
| C: Region C | D: Region D |
| 1 Pile foundation | 2 Drainage hole |
| 3 Overtopping outlet | 4 Anchoring device |
| 5 Steel cables | |

DESCRIPTION OF THE EMBODIMENTS

The embodiments of the invention are described in detail below, but the present invention can be implemented in a variety of different ways as defined and covered by the claims.

To address the shortcomings of the existing technology, we propose the present invention, i.e., a watershed method of control projects for mitigating super large-scale debris flows, as well as the design method and its application in check dams. This method can effectively regulate floods and debris flows while ensuring dam stability, as well as controlling the peak discharges and the scale of the flow. This method is also helpful for reducing the risk of scouring the channel or ditch bank and stabilizing the slope. If the scale of the flood or debris flow exceeds the design standard of the dam, part of the dam is allowed to break, while the dam foundation and the lateral walls remain stable. In this case, floods and debris flows are allowed to pass through the dam. The retained dam foundation and lateral walls dissipate the energy in ground sills, reduce the flow velocity and retard the rapid undercutting of the channel bed. Thus, the threat to downstream residents and major projects can be minimized.

Therefore, the invention first determines the scale corresponding to a given standard flood and debris flow in the basin and estimates the risk of floods. Then, it determines the design standard of the control system according to the prevention requirements of super large-scale floods. Finally, the design methods of check dams with different functional zones are proposed based on the design standard of critical control engineering.

The implementations of the present invention are as follows:

(1) According to the sediment transport capacity of the main river in the lower reaches of the gully, the protection standards of major projects, villages, and towns, the design standards for the prevention and control system in the basin, and the design and protection standards of crucial control engineering are determined. According to the investigation of historical disasters in the basin and measurements of basin topography, as well as field observations of historical flood traces or the hydrological calculation of small watersheds, the peak discharge and the total amount of debris flow are calculated. The source materials of debris flows can also be estimated through field investigations of the distribution of materials in the basin.

(2) The artificial structures or artificial structure arrays that are used to control the initial amount of source materials are installed considering the potential of super large-scale debris flows in the watershed. When the source materials develop into debris flows, uninitiated artificial structures can prevent bed undercutting, and the initiated artificial structures contribute to consuming flow energy through an increase in friction.

(3) If the scale of a flood or glacier debris flow is lower than the design standard (the total discharge of flow is less than $100\times10^4$ $m^3$ or the peak discharge of flow is less than 2000 $m^3/s$), the combination of the drainage channel, check dam, and retaining basin described in the patent "A method for the prevention and control of debris flows based on the transport of the main river" (Patent No. 201010617466.8) is used to prevent and control debris flows.

(4) If the scale of a flood or glacier debris flow is higher than the design standard (the total discharge of flow is larger than $100\times10^4$ $m^3$ or the peak discharge of flow is larger than 2000 $m^3/s$), field investigations and sampling tests are further used to determine the design and layout, as well as the location and quantity of key projects in the basin.

Key control dams are built every 3-5 common check dams, and the storage capacity of the control dams is equal to or greater than the total storage capacity of its upstream common check dams. These dams are helpful to ensure that the control dams retain the sediments that come from the upstream check dams when they break out.

(5) Key control dams can be divided into four regions, namely, region A, the foundation of the dam; region B, the left shoulder of the dam; region C, the right shoulder of the dam; and region D, the discharge outlet and overtopping weir. The four regions are designed based on different protection standards, i.e., regions A, B, and C are designed according to the same standard, and pile foundations can be used to reinforce the foundation. The design standard of region D is lower than that of the other three regions. Region D is allowed to break when encountering super large-scale floods and debris flows, while the other regions A, B, and C are not allowed to burst.

Preferably, the artificial structures or artificial structure arrays can be arranged in the source area if there is a high possibility of large-scale debris flows in the basin. These structures can be prefabricated and distributed evenly or unevenly in the source area.

Ideally, the geometric parameters (e.g., length, width, and height) of the critical control project are determined based on terrain investigations. For example, the thickness of the project foundation and the accumulation layer on both banks can be obtained through actual drilling and sampling tests.

According to the design and protection standards of railways, highways, and other important facilities in the basin, the design and protection standards of the non-outburst damaged area of the critical control project are required to be higher than those of the outburst area.

The same design standards adopted in regions A, B, and C should be greater than or equal to the protection standards of railways, highways, and other important facilities. These regions are constructed with high-grade reinforced concrete.

Preferably, the design standards adopted in region D are lower than those in regions A, B, and C. The building materials of region D are constructed with reinforced concrete, steel cable nets, and flexible protective nets. In the case of super large-scale glacial floods and debris flows, region D is allowed to burst.

The depth of the pile foundation should be determined as follows: the effective length of the pile foundation is greater than or equal to the dam height and crosses through the overburden to the bedrock, i.e., $H>H_{design}$.

If possible, the potential failure areas in region D of the critical control dam include the discharge hole. When the impact force/pressure on the dam exceeds the design standard ($P>P_{design}$) or the debris flow discharges (calculated according to the real-time monitoring data of floods, Q=BHV) exceed the design discharges, region D may begin to fail.

Whether the anchorages in regions B and C are designed as anti-slide piles or prestressed anchorage is based on the thickness of the loose accumulation layer on the shoulders of the dam and the impact resistance requirements of the dam shoulders under the design standards. Moreover, the anchorage depth is determined to be larger than the depth ($h>h_{accumulation\ layer}$).

Due to the adoption of the abovementioned technical scheme, the invention allows noncrucial control structure to be destroyed when super large-scale glacier floods and debris flows occur. Moreover, part of the critical control structure also allows the breakage to increase the cross-sectional areas of flows. The unbroken part of the critical control structure can effectively control channel undercutting and regulate the cross-sectional velocity. These are helpful to improve the safety of prevention systems, as well as protect the operation of railways, highways, and key facilities. Specifically, the invention can regulate super large-scale glacial floods and debris flows by constructing key control projects in the basin on the premise of ensuring the safe operation of railways, highways, and other important facilities in the basin.

Compared with the existing technology, this invention allows part of the critical control dam to break under the condition of ensuring the safe operation of entire systems, thereby increasing the cross-sectional areas and the flow discharges. The unbroken foundation of the dam can effectively control the channel undercutting and regulate the cross-sectional velocity. These are helpful to minimize the threat and harm to the downstream areas. At the same time, the critical control dam can be quickly restored to its original state after the burst, thereby saving construction time and greatly reducing the maintenance cost of the project.

Embodiment 1

Many loose materials lay in a glacial debris flow valley, which has a large slope but a small width (FIG. 1). Climate change has recently led to intense glacier melting and frequent debris flow disasters. Debris flows often block highways and rivers at the mouths of gullies and form barrier lakes, which seriously threaten the safety of passing vehicles and downtown areas. According to an investigation of historical disasters in the valley and the calculation results of debris flow heights, the valley has experienced a 50-year debris flow disaster. The highway at the gully entrance is an important transportation junction leading to the western region, its design standard is P=1%, and the number of people threatened by debris flow disasters is greater than 1,000. Therefore, the design standard for the engineered prevention of debris flows is determined to be P=1%. Using the hydrological calculation method of a small watershed, the total instantaneous discharge of debris flows under the design standard (P=1%) is calculated as $110\times10^4$ $m^3$, and the peak discharge of debris flows is 2200 $m^3/s$. Therefore, the glacier debris flow in this watershed is super large-scale.

The amount of source materials that may be involved in debris flows is determined through field investigations and sampling tests. Therefore, comprehensive prevention of debris flows is planned to be carried out by adopting stabilization and grading control measures. Artificial structures or artificial structure arrays that are used to control the initial amount of source materials are installed when super large-scale debris flows in the watershed occur. When the source materials develop into debris flows, uninitiated artificial structures can prevent bed undercutting, and the initiated artificial structures contribute to consuming flow energy through an increase in friction. Ten conventional check dams and 2 key control check dams should be built in the water basin; in other words, one critical control check dam is planned for every five conventional check dams. The designed storage capacity of each conventional check dam is $11\times10^4$ $m^3$ and that of the critical control check dam is $55\times10^4$ $m^3$. The designed total storage capacity of the proposed prevention and control project is greater than the total instantaneous debris flow volume under the design standard (P=1%). The designed storage capacity of one control check dam is equivalent to the sum of the designed storage capacity of five conventional check dams. According to the field measurements and borehole sampling tests, the dam length of the controlling dam is 140 m, the total dam height is 60 m, and the effective dam height is 46 m. The controlled check dam is divided into four regions, namely, region A (foundation of the dam), region B (left shoulder of the dam), region C (right shoulder of the dam), and region D (the discharge outlet and overtopping weir). According to the design protection standard (P=1%) of the highway at the outlet of the gully, the design protection standard of the non-outburst damage regions (A, B, and C) of the critical control prevention project is determined as P=0.5%, and the design protection standard of outburst region D is determined as P=1%.

The materials of region A are high-grade reinforced concrete and pile foundations to ensure that the foundation can resist strong erosion and undercutting without being damaged in the case of super large-scale glacier floods and debris flows. According to the field measurements and borehole sampling tests, the thickness of the loose accumulation layer of the dam foundation is 20 m; thus, the effective length of the pile foundation is determined to be H=50 m (larger than the effective dam height and the thickness of the loose accumulation layer). The materials of regions B and C are high-grade reinforced concrete. The thickness of the accumulation layer on both banks is 15 m according to drilling and sampling tests. Considering that the thickness of the accumulation layer on both banks is small, anti-slide piles should be used for the dam shoulders, and the anchoring depth h=20 m (larger than the thickness of the accumulation layer). The materials of region D are reinforced concrete, and this region is lower than regions A, B, and C. When the impact force on the dam exceeds the design standard (P=1%) or the debris flow in the basin exceeds the design discharges (2200 $m^3/s$), region B of the controlled check dam automatically fails.

Embodiment 2

Figure 2:
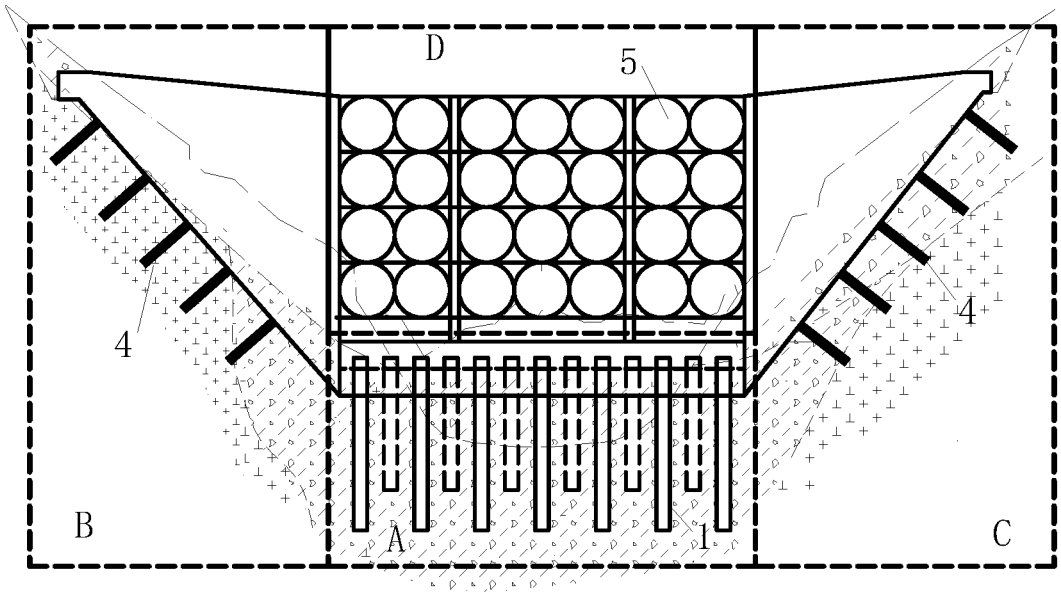
FIG. 2 is a critical control dam with reinforced concrete and steel cables.

Many loose materials lay in a glacial debris flow valley, which has a large slope but a small width (FIG. 2). Climate change has recently led to intense glacier melting and frequent debris flow disasters. According to the investigation of historical disasters in the valley and the calculation results of debris flow height, the valley has experienced a 100-year debris flow disaster. There is an important railway that will be built at the outlet of this gully, and its design standard is P=1%. Debris flow disasters seriously threaten the safety of railways and passengers. Therefore, the design standard for the engineered prevention of debris flows is determined to be P=1%. Resulting from the hydrological calculation of a small watershed, the total instantaneous debris flow discharge under the design standard (P=1%) is $320\times10^4$ $m^3$, and the peak discharge of the debris flow is 3500 $m^3/s$. Therefore, the glacier debris flow in this watershed is super large-scale.

The amount of source materials that may be involved in debris flows is determined through field investigations and sampling tests. Therefore, comprehensive prevention of debris flows is planned to be carried out by adopting stabilization and grading control measures. Artificial structures or artificial structure arrays that are used to control the initial amount of source materials are installed when super large-scale debris flows in the watershed occur. When the source materials develop into debris flows, uninitiated artificial structures can prevent bed undercutting, and the initiated artificial structures contribute to consuming flow energy through an increase in friction. Twenty conventional check dams and 4 key control check dams should be built in the water basin; in other words, one critical control check dam is planned for every five conventional check dams. The designed storage capacity of each conventional check dam is $16\times10^4$ $m^3$ and that of the critical control check dam is $80\times10^4$ $m^3$. The designed total storage capacity of the proposed prevention and control project is greater than the total instantaneous debris flow volume under the design standard (P=1%). The designed storage capacity of one control check dam is equivalent to the sum of the designed storage capacity of five conventional check dams. According to the field measurements and borehole sampling tests, the dam length of the controlling dam is 178 m, the total dam height is 64 m, and the effective dam height is 48 m. The controlled check dam is divided into four regions, namely, region A (foundation of the dam), region B (left shoulder of the dam), region C (right shoulder of the dam), and region D (the discharge outlet and overtopping weir). According to the design protection standard (P=1%) of the highway at the outlet of the gully, the design protection standard of the non-outburst damage regions (A, B, and C) of the critical control prevention project is determined as P=0.5%, and the design protection standard of the outburst region D is determined as P=1%.

The materials of region A are high-grade reinforced concrete and pile foundations to ensure that the foundation can resist strong erosion and undercutting without being damaged in the case of super large-scale glacier floods and debris flows. According to the field measurements and borehole sampling tests, the thickness of the loose accumulation layer of the dam foundation is 25 m; thus, the effective length of the pile foundation is determined to be H=50 m (larger than the effective dam height and the thickness of the loose accumulation layer). The materials of regions B and C are high-grade reinforced concrete. The thickness of the accumulation layer on both banks is 30 m according to drilling and sampling tests. Considering that the thickness of the accumulation layer on both banks is large, a prestressed anchor cable should be used for the dam shoulders, and the anchoring depth h=35 m (larger than the thickness of the accumulation layer). The materials of region D are reinforced concrete, and this region is lower than regions A, B, and C. When the impact force on the dam exceeds the design standard (P=1%) or the debris flow in the basin exceeds the design discharges (3500 $m^3/s$), region D of the controlled check dam automatically bursts.

Embodiment 3

A glacial debris flow valley with a large slope and small width is shown in FIGS. 1 and 2. Due to historical earthquakes, there are abundant loose solid materials in this gully. Moreover, temperature rise has led to severe melting of glaciers and frequent occurrence of debris flows in recent years. According to the investigation of historical disasters in the valley and the calculation results of debris flow height, the valley has experienced a 100-year debris flow disaster. The highway at the gully entrance is an important transportation junction leading to the western region, and its design standard is P=1%. Debris flow disasters seriously threaten residents. Therefore, the design standard for the engineered prevention of debris flows is determined to be P=1%. Calculated by the hydrological calculation method of a small watershed, the total instantaneous debris flow discharge under the design standard (P=1%) is $600\times10^4$ $m^3$, and the peak discharge of debris flows is 5000 $m^3/s$. Therefore, the glacier debris flow in this watershed is super large-scale.

The amount of source materials that may be involved in debris flows is determined through field investigations and sampling tests. Therefore, comprehensive prevention of debris flows is carried out by adopting stabilization and grading control measures. Artificial structures or artificial structure arrays that are used to control the initial amount of source materials are installed when super large-scale debris flows in the watershed occur. When the source materials develop into debris flows, uninitiated artificial structures can prevent bed undercutting, and the initiated artificial structures contribute to consuming flow energy through an increase in friction. Forty conventional check dams and 10 key control check dams are proposed in the water basin; in other words, one critical control check dam is planned for every four conventional check dams. The designed storage capacity of each conventional check dam is $15\times10^4$ $m^3$ and that of the critical control check dam is $60\times10^4$ $m^3$. The designed total storage capacity of the proposed prevention and control project is greater than the total instantaneous debris flow discharge under the design standard (P=1%). The designed storage capacity of one control check dam is equivalent to the sum of the designed storage capacity of four conventional check dams. According to the field measurements and borehole sampling tests, the dam length of the controlling dam is 154 m, the total dam height is 58 m, and the effective dam height is 44 m. The controlled check dam is divided into four regions, namely, region A (foundation of the dam), region B (left shoulder of the dam), region C (right shoulder of the dam), and region D (the discharge outlet and overtopping weir). According to the design protection standard (P=1%) of the highway at the outlet of the gully, the design protection standard of the non-outburst damage regions (A, B, and C) of the critical control prevention project is determined as P=0.5%, and the design protection standard of the outburst region D is determined as P=1%.

The materials of region A are high-grade reinforced concrete and pile foundations to ensure that the foundation can resist strong erosion and undercutting without being damaged in the case of super large-scale glacier floods and debris flows. According to field measurements and borehole sampling tests, the thickness of the loose accumulation layer of the dam foundation is 30 m; thus, the effective length of the pile foundation is determined to be H=46 m (larger than the effective dam height and the thickness of the loose accumulation layer). The materials of regions B and C are high-grade reinforced concrete. The thickness of the accumulation layer on both banks is 10 m according to drilling and sampling tests. Considering that the thickness of the accumulation layer on both banks is small, a slide-resistant pile should be used for the dam shoulders, and the anchoring depth h=20 m (larger than the thickness of the accumulation layer). The materials of region D are steel cables and flexible nets. When the impact force on the dam exceeds the design standard (P=1%) or the debris flow in the basin exceeds the design discharges (5000 $m^3$/s), region D of the controlled check dam automatically bursts.

The above descriptions are only the preferred embodiments of the invention and are not intended to limit the invention. The present invention is subject to various modifications and variations for technical personnel in the field. Any modification, equivalent replacement, improvement, etc. made within the spirit and principle of the invention should be included in the protection scope of the invention.

What is claimed is:

1. A method for the prevention of floods having a total discharge volume of more than 100×104 $m^3$ or a peak flow of more than 2000 $m^3$/s and debris flows, comprising:

determining a planning and design standards of an engineered prevention system in a basin, and a design protection level and standards of a key project according to protection standards of downstream objects; obtaining a basin topography according to investigation and measurements of historical disasters in the basin; calculating the peak discharge or a total debris flow volume based on field investigations of historical flood traces or hydrological calculations of small watersheds; and estimating source materials of debris flows through a field investigation of distribution of materials in the basin;

when considering potential debris flows in the basin, arranging artificial structures or artificial structure arrays to control an initial amount of source materials, such that the artificial structures protects a bed incision by flows and increases flow friction, which contributes to regulating energy consumption;

if a flood erupts in the basin under a certain design standard, using a combination of the drainage channel, check dam, and retaining basin to regulate the floods and debris flows;

if a flood erupts in the basin under a certain design standard, using field investigations and sampling tests to determine locations and quantity of key projects in the basin; wherein key control dams are placed every 3-5 common check dams, and a storage capacity of a control dam is equal to or greater than a total storage capacity of its upstream common check dams, such that the control dam retains sediments that come from upstream check dams when upstream check dams break out;

dividing the key control dams into four regions comprising: region A, a foundation of a dam body; region B, a left shoulder of the dam body; region C, a right shoulder of the dam body; and region D, a discharge outlet and overtopping weir; wherein the four regions are designed based on different protection standards; wherein the regions A, B, and C are designed according to a same standard, and a pile foundation is used to reinforce the foundation of the dam body; wherein a design standard of region D is lower than that of the other three regions; wherein region D is allowed to break when encountering floods and debris flows, while the regions A, B, and C are not allowed to burst.

2. The method according to claim 1, wherein the artificial structures or artificial structure arrays are installed in a source area of the basin when considering the potential debris flows in the basin, wherein the artificial structures or artificial structure arrays are prefabricated and either evenly or unevenly dispersed in the source area.

3. The method according to claim 1, wherein parameters of a critical control dam are determined based on the basin topography; wherein a thickness of the foundation of the dam body and a accumulation layer on both banks are determined through actual drilling and sampling tests.

4. The method according to claim 1, wherein design protection standards of non-breakable areas are required to be higher than that of outburst areas based on protection standards of important facilities.

5. The method according to claim 1, wherein design grades and standards adopted in the region A are greater than or equal to a protection grade of railways, highways, and other important facilities; wherein the design grades and standards adopted in the regions B and C are the same as those in region A; and wherein materials in these regions are high-grade reinforced concrete.

6. The method according to claim 1, wherein design grades and standards adopted in the region D are lower than the design grades and standards in the regions A, B, and C; wherein materials of the region D are reinforced concrete, steel cable nets, and flexible protective nets; and wherein in the case of glacial floods and debris flows, the region D is allowed to burst.

7. The method according to claim 1, wherein a depth of the pile foundation is determined as follows: an effective length of the pile foundation (Hpile) is greater than or equal to a dam height (Hdam) and crosses through a depth of loose deposits (Hdeposits), namely, Hpile>Max (Hdam, Hdeposits).

8. The method according to claim 1, wherein potential failure areas of the region D of the critical control dam include the discharge outlet; and wherein when impact force/pressure on the dam exceeds a design standard or debris flow discharges (calculated according to the real-time monitoring data of floods and debris flows, Q=BHV) exceed design discharges, the region D may begin to fail.

9. The method according to claim 1, wherein whether anchorages in the regions B and C are designed as anti-slide piles or prestressed anchorages are based on a thickness of a loose accumulation layer (hdeposit layer) on the left shoulder and right shoulder of the dam body and impact resistance requirements of the left shoulder and right shoulder of the dam body; and wherein an anchorage depth is determined, which is larger than the thickness of the loose accumulation layer.

* * * * *